US012601252B2

(12) United States Patent
Yarman

(10) Patent No.: US 12,601,252 B2
(45) Date of Patent: Apr. 14, 2026

(54) PREDICTIONS OF GAS CONCENTRATIONS IN A SUBTERRANEAN FORMATION

(71) Applicant: SCHLUMBERGER TECHNOLOGY CORPORATION, Sugar Land, TX (US)

(72) Inventor: Can Evren Yarman, Clamart (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 19/104,370

(22) PCT Filed: Sep. 21, 2023

(86) PCT No.: PCT/US2023/074737
§ 371 (c)(1),
(2) Date: Feb. 18, 2025

(87) PCT Pub. No.: WO2024/064790
PCT Pub. Date: Mar. 28, 2024

(65) Prior Publication Data

US 2025/0257651 A1 Aug. 14, 2025

(30) Foreign Application Priority Data

Sep. 21, 2022 (EP) ..... 22306386

(51) Int. Cl.
*E21B 47/10* (2012.01)

(52) U.S. Cl.
CPC ..... *E21B 47/10* (2013.01); *E21B 2200/20* (2020.05)

(58) Field of Classification Search
CPC ..... E21B 47/10; E21B 2200/20
See application file for complete search history.

(56) References Cited

U.S. PATENT DOCUMENTS 5,710,726 A 1/1998 Rowney et al.
2007/0112547 A1 5/2007 Ghorayeb et al.
2010/0089120 A1* 4/2010 Hanson ..... E21B 49/005 73/19.09
2011/0288842 A1 11/2011 Gutierrez Ruiz et al.
(Continued)

FOREIGN PATENT DOCUMENTS

EP 2500513 A1 * 9/2012 ..... E21B 47/11

OTHER PUBLICATIONS

International Search Report and Written Opinion of International Patent Application No. PCT/US2023/074737 dated on Jan. 18, 2024, 11 pages.
(Continued)

*Primary Examiner* — Catherine T. Rastovski
*Assistant Examiner* — Sharad Timilsina
(74) *Attorney, Agent, or Firm* — Kyle R. Miiller

(57) ABSTRACT

A method for estimating a formation gas concentration while drilling includes making first gas concentration measurements in drilling fluid as the drilling fluid exits a wellbore or second gas concentration measurements in drilling fluid before the drilling fluid is pumped into the wellbore while drilling the wellbore. The first gas concentration measurements or the second gas concentration measurements may be evaluated with a model to estimate the formation gas concentration.

14 Claims, 3 Drawing Sheets

(56) References Cited

U.S. PATENT DOCUMENTS

2016/0123141 A1* 5/2016 Rowe ..... E21B 49/003
702/13
2016/0273353 A1 9/2016 Rowe et al.

OTHER PUBLICATIONS

Bachler, S. et al., "Control of Cooling Loops With Large and Variable Delays", 2017 IEEE Conference on Control Technology and Applications (CCTA), 2017, pp. 1207-1212, IEEE Xplore, Maui, HI, USA.
Kicsiny, R., "New Delay Differential Equation Models for Heating Systems With Pipes", International Journal of Heat and Mass Transfer, Elsevier, Dec. 2014, pp. 807-815, vol. 79, Science Direct.
Pekař, L. et al., "Algebraic Robust Control of a Closed Circuit Heating-Cooling System With a Heat Exchanger and Internal Loop Delays", Applied Thermal Engineering, Elsevier, Feb. 25, 2017, pp. 1464-1474, vol. 113, Science Direct.
Bekiaris-Liberis, N. et al., "Nonlinear Control Under Nonconstant Delays", Society for Industrial and Applied Mathematics, 2013, 11 pages, University of California at San Diego, La Jolla, California.
Kuwabara, T. et al., "Investigation of Decarburization Behavior in RH-Reactor and Its Operation Improvement", Transactions of the Iron and Steel Institute of Japan, 1988, pp. 305-314, 28(4), J-Stage, Japan.
Takahashi, M. et al., "Mechanism of Decarburization in RH Degasser", ISIJ international, 1995, pp. 1452-1458, 35 (12), J-Stage, Japan.
Zhang, J. et al., "Mathematical Model for Decarburization Process in RH Refining Process", ISIJ international, 2014, pp. 1560-1569, 54(7), J-Stage, Beijing, China.

* cited by examiner

PREDICTIONS OF GAS CONCENTRATIONS IN A SUBTERRANEAN FORMATION

CROSS REFERENCE TO RELATED APPLICATIONS

This application is a National Stage Entry of International Application No. PCT/US2023/074737, filed on Sep. 21, 2023, which claims priority to European Patent Application No. 22306386.8, which was filed on Sep. 21, 2022, and is incorporated herein by reference in its entirety.

BACKGROUND

When drilling a well for the production of hydrocarbons, drilling fluid is often circulated through the well for a number of purposes. For example, drilling fluid is commonly intended to provide pressure to the subterranean formation, cool and lubricate the drill bit, flush cuttings away from the drill bit and carry them to the surface, and provide hydraulic power to various downhole tools. Drilling fluids also commonly carry formation fluids and dissolved formation gasses to the surface. Such gasses may be liberated by the drill bit as it cuts the formation and may include various alkane gasses such as methane, ethane, propane, butane, pentane, and the like.

Gas concentration measurements are commonly made at one or more surface locations, for example, as the gas emerges from the wellbore and prior to being pumped back downhole. The measured gas concentrations are sometimes referred to in the industry as gas-out (fluid emerging from the wellbore) and gas-in (just prior to the fluid being re-circulated downhole). Such measurements may provide valuable information to a mud logger, for example, indicating fluid degassing rates and which types of gases are present in the drilled formations. However, there is room for further improvement. For example, there is a need in the industry to further estimate gas concentrations in the formation (e.g., in the rock itself) for both land and offshore drilling rigs.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Embodiments of this disclosure include methods and systems for estimating a formation gas concentration while drilling. In one example embodiment, a method for estimating a formation gas concentration includes making first (gas-out) gas concentration measurements in drilling fluid as the drilling fluid exits a wellbore or second (gas-in) gas concentration measurements in drilling fluid before the drilling fluid is pumped into the wellbore while drilling the wellbore and estimating the formation gas concentration by evaluating the first gas-out measurements or the second gas-in measurements with a model. In certain example embodiments, the model may include coupled surface and subsurface models in which the surface model is configured to estimate gas transport and degassing of the drilling fluid in surface equipment and to output gas-in concentrations and a subsurface model configured to estimate formation gas mixing with the drilling fluid as the formation gas is released from the formation during drilling and to output gas-out concentrations.

Figure 1:
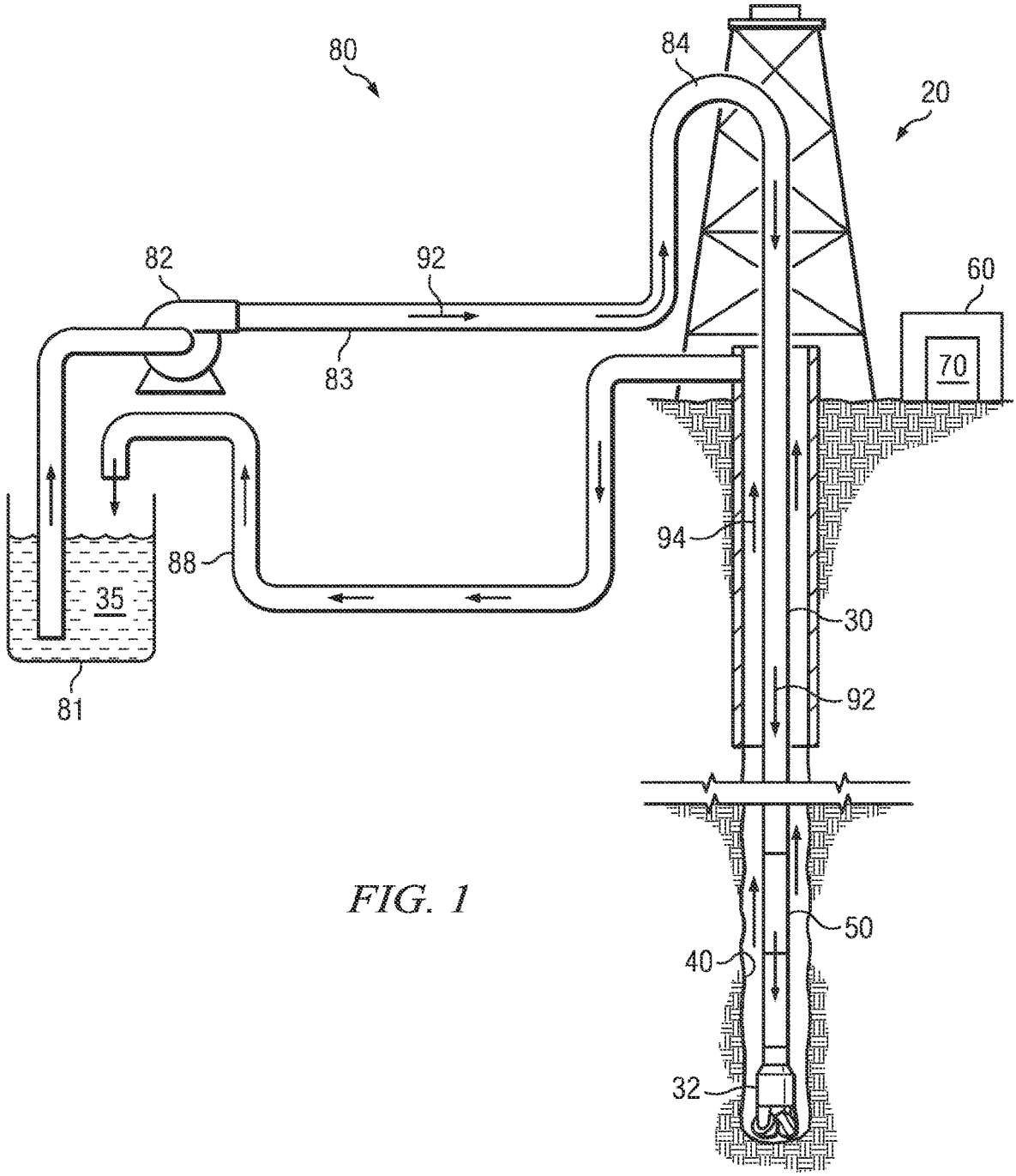
FIG. 1 depicts an example drilling rig including a system for predicting formation gas concentrations.

FIG. 1 depicts an example drilling rig 20 including a system 60 for estimating formation gas concentrations while drilling. The drilling rig 20 may be positioned over a subterranean formation (not shown). The rig may include, for example, a derrick and a hoisting apparatus (also not shown) for raising and lowering a drill string 30, which, as shown, extends into wellbore 40 and includes, for example, a drill bit 32 and one or more downhole measurement tools 50 (e.g., a logging while drilling tool and/or a measurement while drilling tool).

Drilling rig 20 further includes a surface system 80 for controlling the flow of drilling fluid used on the rig (e.g., used in drilling the wellbore 40). In the example rig depicted, drilling fluid 35 is pumped downhole (as depicted at 92) via a mud pump 82. The drilling fluid 35 may be pumped, for example, through a standpipe 83 and mud hose 84 in route to the drill string 30. The drilling fluid typically emerges from the drill string 30 at or near the drill bit 32 and creates an upward flow 94 of mud through the wellbore annulus (the annular space between the drill string and the wellbore wall). The drilling fluid then flows through a return conduit 88 and solids control equipment to a mud pit 81. It will be appreciated that the terms drilling fluid and mud are used synonymously herein.

While FIG. 1 depicts a land rig 20, it will be appreciated that the disclosed embodiments are equally well suited for land rigs or offshore rigs. As described in more detail below, and as known to those of ordinary skill, offshore rigs commonly include a platform deployed atop a riser that extends from the sea floor to the surface. The drill string extends downward from the platform, through the riser, and into the wellbore through a blowout preventer (BOP) located on the sea floor. As described in more detail below with respect to FIG. 4, example embodiments disclosed herein may make use of a model that is configured for use with either a land rig or an offshore rig.

System 60 may be located on the rig site or at an offsite location. The system may include substantially any suitable computer hardware and software configured to process gas concentration measurements using a mathematical model. To perform these functions, the hardware may include one or more processors (e.g., microprocessors) which may be connected to one or more data storage devices (e.g., hard drives or solid state memory). The hardware may further include a network interface to enable communication with one or more gas measurement modules 70. Such computer hardware is well known and ubiquitous. It will, of course, be understood that the disclosed embodiments are not limited to the use of or the configuration of any particular computer hardware and/or software.

As further depicted in FIG. 1, surface system 80 may include one or more gas measurement modules 70 (e.g., gas chromatographs and/or mass spectrometers) configured, for example, to measure concentrations of various alkane gases in the drilling fluid (such as methane, ethane, propane, butane, pentane, and the like). The measurement module(s) 70 may be located in a rig laboratory or may include portable instruments located adjacent to the surface equipment (e.g., adjacent to a degasser). The measurement module(s) 70 are generally configured to measure gas concentrations in the fluid as it exits the wellbore 40 (referred to herein as gas-out) and prior to re-entering the wellbore 40 (referred to herein as gas-in).

Figure 2:
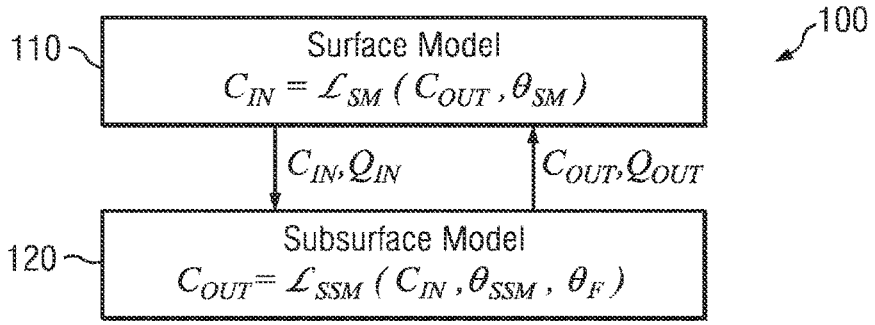
FIG. 2 depicts a block diagram of an example model for predicting formation gas concentrations.

FIG. 2 depicts a block diagram of an example model 100 for predicting formation gas concentrations. The formation gas concentrations may be predicted, for example, from surface measurements of gas concentrations in the circulating drilling fluid. Such surface measurements may include gas-out measurements or gas-in measurements. The depicted model 100 may include a surface model 110 coupled with a subsurface model 120. By coupled it is meant that the output from the surface model 110 is the input to the subsurface model 120 and/or that the output from the subsurface model 120 is the input to the surface model 110. In the example embodiment shown, the input to the surface model 110 (and the output from the subsurface model 120) may be gas-out $C_{OUT}$. The input to the subsurface model 120 (and the output from the subsurface model 110) may gas-in $C_{IN}$.

In example embodiments disclosed herein, the surface model 110 may be configured, for example, to relate $C_{IN}$ and $C_{OUT}$ such that $C_{IN}$ may be predicted from $C_{OUT}$ measurements or that $C_{OUT}$ may be back-predicted from $C_{IN}$ measurements. Likewise, the subsurface model 120 may be configured, for example, to relate $C_{OUT}$ to $C_{IN}$, the formation gas concentrations $C_F$, and the volume rate of drilling $V_{ROP}$ such that $C_F$ may be estimated from either $C_{IN}$ or $C_{OUT}$ measurements made at the surface. For example, the surface and subsurface models may be expressed as follows:

$$C_{IN} = \mathcal{L}_{SM}(C_{OUT}, \theta_{SM}) \tag{1}$$

$$C_{OUT} = \mathcal{L}_{SSM}(C_{IN}, \theta_{SSM}, \theta_F) \tag{2}$$

where $\mathcal{L}_{SM}$ and $\mathcal{L}_{SSM}$ represent surface model and subsurface model operators that transform $c_{OUT}$ to $c_{IN}$ and $c_{IN}$ to $c_{OUT}$, respectively, $\theta_{SM}$ and $\theta_{SSM}$ represent surface and subsurface model parameters that are independent of the formation and $\theta_F$ represent formation related subsurface parameters. The surface parameters $\theta_{SM}$ may include, for example, the rig configuration, rig equipment, environmental factors such as temperature, barometric pressure, and other weather parameters, and drilling fluid properties. The subsurface parameters $\theta_{SSM}$ may include, for example, drilling fluid flow rates, rig configuration such as land versus offshore, drilling fluid properties, wellbore geometry, and drilling parameters such as rate of penetration, weight on bit, and drill string rotation rate. The formation parameters $\theta_F$ may include, for example, the formation porosity $\phi$, formation gas concentration $C_F$, and gas types.

Figure 3:
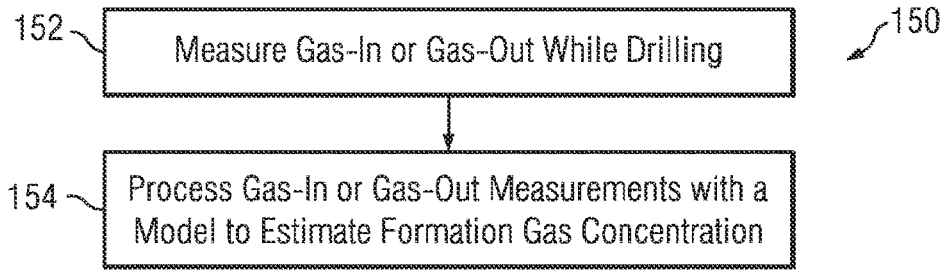
FIG. 3 depicts a flow chart of one example method for predicting formation gas concentrations while drilling.

FIG. 3 depicts a flow chart of one example method 150 for predicting formation gas concentrations while drilling. The method 150 includes measuring gas-out or gas-in concentrations while drilling at 152. The gas-out or gas-in concentration measurements may then be evaluated using a model, for example, including coupled surface and subsurface models, to estimate the gas concentration in the subterranean formation at 154. For example only, gas-out measurements made while drilling may be evaluated using the surface model 110 (FIG. 2) to predict corresponding gas-in values. The predicted gas-in values may be further evaluated using the subsurface model 120 (FIG. 2) to predict gas-out values. The predicted gas-out values may be compared with the gas-out measurements to estimate the formation gas concentration. The disclosed embodiments are now described in more detail by way of the following example implementations.

Figure 4:
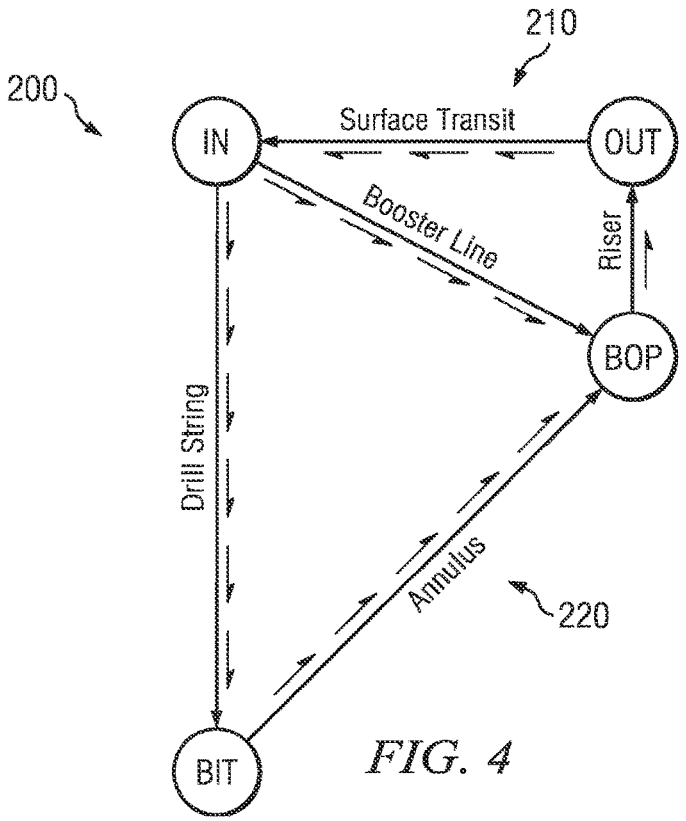
FIG. 4 depicts a fluid flow diagram of another example model for predicting formation gas concentrations.

FIG. 4 depicts a fluid flow diagram of another example model 200 for predicting formation gas concentrations. The depicted flow diagram is configured for an offshore drilling rig, but may also be utilized for land operations (as described in more detail below). The depicted model includes four distinct nodes, labelled herein as: IN, BIT, BOP, and OUT with five distinct edges (or flow paths) connecting the nodes. The depicted flow paths include the drill string that connects IN and BIT, the wellbore annulus that connects BIT and BOP, a booster line that connects IN and BOP, the riser that connects BOP and OUT, and a surface transit path that connects OUT and IN. It will be appreciated that model 200 may be thought of as including a surface model 210 (the surface transit path) and a subsurface model 220 (the drill string, wellbore annulus, booster line, and riser paths) that are coupled at the IN and OUT nodes with the subsurface model 220 further including first and second additional mixing nodes (the BIT and BOP nodes in FIG. 4).

As is known to those of ordinary skill in the drilling industry, an offshore rig commonly includes a platform deployed on a riser that extends to a blowout preventer (BOP) located on the sea floor. The drill string extends from the platform, through the riser and BOP, and into wellbore. During a drilling operation, drilling fluid emerges from the drill bit at the bottom of the wellbore where it mixes with drill cuttings and formation gas that are generated during drilling. Offshore rigs commonly further include a supplementary booster flow line extending from the mud tank system to the BOP. The fluid pumped down through the booster line mixes with the upwardly flowing fluid in the annulus and then flows to the surface through the riser. The booster flow is commonly employed to assist raising drill cuttings to the surface (particularly in deep water operations).

With continued reference to FIG. 4, the surface model 210 transforms the gas concentrations and flow rates coming out of the well to gas concentrations and flow rates going in to the well. For example, the surface model 210 may be thought of as a transfer function that models (or predicts) gas transport and degassing of the drilling fluid at the surface (e.g., in the mud tank system 81 depicted on FIG. 1). In example embodiments, such a transfer function may be configured to output predicted formation gas concentrations corresponding to gas-out measurements made at the surface. Irrespective of the form of the surface model 210, the aim of modelling mud flow at the surface is to relate the gas concentrations and flow rates coming out of the well OUT to the gas concentration and flow rate going into the well IN.

It will be appreciated that the gas-out concentration $C_{OUT}$ generally decreases as it moves through the surface equipment, e.g., owing to its interaction with the equipment and its exposure to the air. Pressure differences between the mud and air at the surface, as well as the mechanical interaction of the mud with the surface equipment and other components of the circulation system facilitate degassing of the mud. By the time the mud is pumped out of the mud tank system down into the wellbore, the gas concentration may be significantly reduced. One aspect of the disclosed embodiments was the realization that the gas-in concentration $C_{IN}$ may be modelled using an ordinary first order differential equation, for example, as follows:

$$d_t\tilde{C}_{IN}(t) = C_{OUT}\left(\frac{t-\Delta t_{STT}(t)}{\sigma_{STT}(t)}\right)a_{01}(t) - \tilde{C}_{IN}(t)a_1(t) \tag{3}$$

where $\tilde{C}_{IN}(t)$ represents the modeled gas-in, with $d_t\tilde{C}_{IN}(t)$ representing the first derivative of $\tilde{C}_{IN}(t)$ with respect to time, $C_{OUT}$ (t) represents the measured gas-out, and $a_1(t)$, $a_{01}(t)$, $\Delta t_{STT}$ (t), and $\sigma_{STT}(t)$ represent model parameters. In Eq. (3), $a_1(t)\geq 0$ and is related to a stationary degassing rate at the mud tank system. The parameter $a_{01}(t)=q_{01}(t)\cdot a_1(t)\in[0, a_1(t)]$ and is related to a dilution rate of gas-out and thereby represents a fraction $q_{01}$ of gas-out contributing to gas-in. The parameter $\Delta t_{STT}(t)\geq 0$ represents the delay associated with surface transit time (STT) of the drilling fluid. Larger $a_1(t)$ values indicate higher stationary degassing rates while smaller $a_{01}(t)$ values indicate higher degassing rates of gas-out until it mixes with gas-in. In addition to delay and dilution rates, the parameter $\sigma_{STT}\geq 1$ is intended to accommodate dispersion that may result in peak widening of gas-in peaks with respect to corresponding gas-out peaks.

Although it is not explicitly recited in Eq. (3), the model parameters may implicitly depend on numerous drilling conditions including, for example, various mud properties (e.g., rheology, density, etc.), the specific gas being measured (e.g., methane, ethane, propane, butane, pentane, etc.), the environmental conditions (e.g., temperature, atmospheric pressure, etc.), and certain operational factors (e.g., flow rate, rig design, status of surface equipment, etc.). This association may be represented mathematically, for example, as follows:

$$a_1=f_1(\theta);a_{01}=f_{01}(\theta);\Delta t_{STT}=f_{\Delta t}(\theta);\sigma_{STT}=f_\sigma(\theta)$$

where $f_1(\theta)$, $f_{01}(\theta)$, $f_{\Delta t}(\theta)$, $f\sigma(\theta)$ indicate that the model parameters $a_1$, $a_{01}$, $\Delta t_{STT}$, and $\sigma_{STT}$ are functions of or related to the drilling conditions θ. For example, considering the four drilling conditions: flow rate ($Q(t)\in\mathbb{R}^+$), density ($\rho(t)\in\mathbb{R}^+$), temperature ($T(t)\in\mathbb{R}$), and a binary degasser status ($DG(t)\in\{0,1\}$), the model parameters may be captured by the following relationship:

$$a_1(t)=f_1(Q(t),\rho(t),T(t),DG(t))$$

$$a_{01}(t)=f_{01}(Q(t),\rho(t),T(t),DG(t))$$

$$\Delta t_{STT}(t)=f_{\Delta t}(Q(t),\rho(t),T(t),DG(t))$$

where $f_1(\bullet)$, $f_{01}(\bullet)$, and $f_{\Delta t}(\bullet)$ indicate that the model parameters $a_1(t)$, $a_{01}(t)$, and $\Delta t_{STT}(t)$ are functions of or related to the flow rate, density, temperature, and degasser status. In this example $\sigma_{STT}(t)$ is taken to be equal to unity such that there is no dispersion of the gas-out measurements. The disclosed embodiments are, of course, not limited in this regard.

With continued reference to FIG. 4, the subsurface model 220 may be configured to transform the gas concentrations and flow rates going into the well to gas concentrations and flow rates coming out of the well (i.e., to transform gas-in to gas-out as described above). The aim of modelling mud flow in the subsurface is to relate gas concentrations and flow rates going into the well at IN to the gas concentration of rates coming out of the well at OUT. In the analysis that follows, let C(t, x) and Q(t, x) denote the gas concentration and flow rate at time t and position x in the circulation system. The subsurface as a whole may be modelled, for example, as described above with respect to Eq. (2), as follows:

$$\mathcal{L}_{SSM}:[C(t, x_{IN}), \theta_{SSM}(t, x_{IN}), \theta_F(t) \rightarrow C(t, x_{OUT}), \theta(t, x_{OUT})] \tag{4}$$

where $\mathcal{L}_{SSM}$ represents the subsurface model operator that transforms $c_{IN}$ to $c_{OUT}$. Drilling fluid circulation in the subsurface model 220 may be sub-modelled in terms of the four flow paths described above: (i) the drill string, (ii) the wellbore annulus, (iii) the booster line, and (iv) the riser.

The drill string may be modelled, for example, as follows:

$$\mathcal{L}_{DS}:[C_1(t, x_{IN}), Q_1(t, x_{IN}) \rightarrow C_1(t, x_{BIT}(t)), Q_1(t, x_{BIT}(t))] \tag{5}$$

where $\mathcal{L}_{DS}$ represents the drill string modelling operator that maps the gas concentration and flow rate at IN to the gas concentration and flow rate at BIT, $C_1(t, x_{IN})$ represents the gas concentration in the fluid pumped downhole (e.g., as measured in the mud pit prior to pumping the fluid downhole or as estimated using the surface model 210 from gas-out measurements), and $Q_1(t, x_{IN})$ represents the flow rate of the drilling fluid pumped into the drill string (e.g., by surface mud pumps). In Eq. (5), $C_1(t, x_{BIT}(t))$ and $Q_1(t, x_{BIT}(t))$ represent the gas concentration and the flow rate of the drilling fluid as it arrives at the drill bit. In example embodiments, $C_1(t, x_{IN})$ may be taken to be equal to $C_{IN}(t)$ and $C_1(t, x_{BIT}(t))$ may be taken to be equal to a delayed version of $C_1(t, x_{IN})$ such that $C_1(t, x_{BIT}(t)) = C_1(t-\Delta t(x_{BIT}(t)), x_{IN})$. Moreover, flows $Q_1(t, x_{BIT}(t))$ and $Q_1(t, x_{IN})$ may be equal or proportional to one another depending on the relative cross-sectional areas of the flow channels in the upper drill string and bottom hole assembly (BHA).

The annulus may be modelled, for example, as follows:

$$\mathcal{L}_{AN}: [C_2(C, x_{BIT}(t)), Q_2(t, x_{BIT}(t)) \rightarrow C_2(t, x_{BOP}), Q_2(t, x_{BOP})] \tag{6}$$

where $\mathcal{L}_{AN}$ represents the modelling operator in the annulus that maps the gas concentration and flow rate at the bit rock interface BIT to the gas concentration and flow rate at BOP, $C_2(t, x_{BIT}(t))$ represents the gas concentration at the bit rock interface BIT, and $Q_2(t, x_{BIT}(t))$ represents the flow rate at the bit rock interface BIT. In example embodiments, $C_2(t, x_{BOP})$ may be taken to be equal to a delayed version of $C_2(t, x_{BIT}(t))$.

At the bit rock interface, formation gas (e.g., gas that is trapped or dissolved in the formation) mixes with the drilling fluid as the formation rock is crushed during drilling. Assuming that the volume of rock that is crushed (the volume rate of penetration) is proportional to the rate of penetration (ROP) and the cross-sectional area of the wellbore (or bit), the mixing at the rock bit interface may be modelled, for example, as follows:

$$C_2(t, x_{BIT}(t)) = \frac{C_F(t)\cdot V_{GAS}(t) + C_1(t, x_{BIT}(t))\cdot Q_1(t, x_{BIT}(t))}{V_{GAS}(t) + Q_1(t, x_{BIT}(t))} \tag{7}$$

where $C_F(t)$ represents the gas concentration in the formation, $V_{GAS}(t)=\phi(t)\cdot V_{ROP}(t)$ is the volume of extracted gas with $V_{ROP}(t)$ representing the volume rate of penetration which in certain embodiments may be given as follows: $V_{ROP}(t)=ROP(t)\cdot\pi(r_{hole})^2$, and $\phi(t)\in[0,1]$ is a fraction that may be, for example, related to the porosity of the drilled formation. It will be appreciated that $Q_1(t, x_{BIT}(t))$ and $Q_2(t, x_{BIT}(t))$ may be proportional to one another with a proportionality constant equal to a ratio of the bit opening to the cross section of the well. The volume rate of penetration (and therefore the volume of extracted gas) is commonly much less than the flow rates $Q_1(t, x_{BIT}(t))$ and $Q_2(t, x_{BIT}(t))$ and can often be ignored in the denominator of Eq. (7). However, because $C_F(t)$ may be comparable to or even considerably larger than $C_1(t, x_{BIT}(t))$ the product $C_F(t)\cdot V_{ROP}(t)$ may be comparable to the product $C_1(t, x_{BIT}(t))\cdot Q_1(t, x_{BIT}(t))$. Those of ordinary skill will readily appreciate that ROP(t) is commonly measured at the surface using traveling block position measurements made while drilling (e.g., by differentiating the traveling block position with time).

The booster line may be modelled, for example, as follows:

$$\mathcal{L}_{BL}: [C_3(t, x_{IN}), Q_3(t, x_{IN}) \rightarrow C_3(t, x_{BOP}), Q_3(t, x_{BOP})] \quad (8)$$

where $\mathcal{L}_{BL}$ represents the modelling operator in the booster line that maps the gas concentration and flow rate at IN to the gas concentration and flow rate at the blowout preventer BOP. Note that in many rig configurations $C_3(t, x_{IN})=C_1(t, x_{IN})$ since the drilling fluid is pumped into the drill string and into the booster line from the same mud pit. However, in many rig configurations $Q_3(t, x_{IN})\neq Q_1(t, x_{IN})$ as distinct pumps are often used to feed the drill string and booster line. Moreover, in example embodiments, $C_3(t, x_{BOP})$ may be taken to be equal to a delayed version of $C_3(t, x_{IN})$.

The riser may be modelled, for example, as follows:

$$\mathcal{L}_{RS}: [C_4(t, x_{BOP}), Q_4(t, x_{BOP}) \rightarrow C_4(t, x_{OUT}), Q_4(t, x_{OUT})] \quad (9)$$

where $\mathcal{L}_{RS}$ represents the modelling operator in the riser that maps the gas concentration and flow rate at BOP to the gas concentration and flow rate at OUT, $C_4(t, x_{BOP})$ represents the gas concentration at the blowout preventer BOP, and $Q_4(t, x_{BOP})$ represents the flow rate at the blowout preventer BOP. In example embodiments, $C_4(t, x_{OUT})$ may be taken to be equal to a delayed version of $C_4(t, x_{BOP})$.

The mixing of annular and booster line flows and concentrations at BOP may be modelled, for example, as follows:

$$Q_4(t, x_{BOP}) = Q_2(t, x_{BOP}) + Q_3(t, x_{BOP}) \quad (10)$$

$$C_4(t, x_{BOP}) = \frac{C_2(t, x_{BOP})\cdot Q_2(t, x_{BOP}) + C_3(t, x_{BOP})\cdot Q_3(t, x_{BOP})}{Q_2(t, x_{BOP}) + Q_3(t, x_{BOP})} \quad (11)$$

With continued reference to FIG. 4 and Eqs. (5)-(11), it will be appreciated that the subsurface model 220 maps the gas concentration and fluid flows from node IN to node OUT and accounts for mixing of formation gas into the circulating drilling fluid at node BIT. Moreover, the quantity of formation gas mixed into the fluid at node BIT may be directly proportional to the gas concentration in the formation $C_F(t)$ and to the volume rate of penetration of drilling $V_{ROP}(t)$, which is in turn directly proportional to the rate of penetration of drilling ROP(t). It will therefore be appreciated that the model may be configured to process a set of gas-in or gas-out measurements and ROP(t) to estimate the gas concentration in the formation $C_F(t)$.

In certain embodiments, the surface model 210 and the subsurface model 220 may be expressed as a set of differential equations (e.g., as described above for the surface model and in more detail below for one particular subsurface model configuration). In such embodiments, the model may be calibrated (or optimized) using a set of gas-in or gas-out measurements and ROP(t) to estimate the gas concentration in the formation $C_F(t)$. For example, in one embodiment, the model may be configured to process differences between first and second gas-out measurements (temporally separated by a circulation time of the drilling fluid) to calibrated the model and estimate the gas concentration in the formation $C_F(t)$. In another example embodiment, gas-out measurements may be processed using the surface model 210 to estimate subsequent gas-in values. The estimated gas-in values may then be processed using the subsurface model 220 to predict gas-out from the modelled $\tilde{C}_4(t, x_{OUT})$, for example, as follows:

$$d_t\tilde{C}_{OUT}(t) = \tilde{C}_4(t, x_{OUT})\, a_{40}(t) - \tilde{C}_{OUT}(t)\, a_0(t) \quad (12)$$

where $\tilde{C}_{OUT}(t)$ represents the modeled gas-out, with $d_t\tilde{C}_{OUT}(t)$ representing the first derivative of $\tilde{C}_{OUT}(t)$ with respect to time, and $a_{40}(t)=q_{40}(t)\cdot a_0(t)$. As noted above, in example embodiments, $\tilde{C}_4(t, x_{OUT})$ may be taken to be equal to a riser delayed $C_4(t, x_{BOP})$ (e.g. as given in Eq. (11)) and $C_2(t, x_{BOP})$ may be taken to be equal to an annulus delayed $C_2(t, x_{BIT}(t))$ (e.g., as given in in Eq. (7)) which is in turn related to $C_F(t)$ and $V_{ROP}(t)$. The model parameters and $C_F(t)$ may then be adjusted such that the predicted gas-out is within a threshold of the measured gas-out to estimate $C_F(t)$.

It will be appreciated that subsurface model 220 is a general model that may be used for both offshore drilling rigs and land-based drilling rigs. For example, for a land rig, the flow rate in the booster line and the height of the riser may both be set equal to zero. In other words, for a land rig $Q_3(t, x_{IN})=Q_3(t, x_{BOP})=0$ in Eq. (8) and $x_{OUT}=x_{BOP}$ in Eqs. (8) and (9). These conditions simplify the subsurface model 220 such that it includes only a single node at BIT and two distinct flow path edges, the first of which connects IN and BIT and the second of which connects BIT and OUT. This simplified model may be used as described above to process a set of gas-in or gas-out measurements and ROP(t) to estimate $C_F(t)$.

One example land rig solution is now described in more detail below. As described above, drilling fluid may be mixed with formation gases and liquids during its interaction with the formation. In the absence of such mixing, a measured gas-out is observed as a delayed version of the measured (or modelled) gas-in. The time delay is the circulation time (CT) that it takes the mud to go down through the drill string and circulate back to the well head.

In the presence of mixing, the drilling fluid acquires additional gas at the bit (e.g., an increased concentration of the measured gasses) as it circulates through the wellbore (thereby resulting in a change or increase in gas-out as compared to gas-in). This change in gas-out may be modeled as another delay first order ordinary differential equation. For example, the change in gas-out for a land rig such as depicted on FIG. 2 may be modeled as follows:

$$d_t\tilde{C}_{OUT}(t) = \tilde{C}_{IN}(t-\Delta t_{CT})a_{10}(t) + \tilde{C}_F(t-\Delta t_{LT})a_{F0}(t) - \tilde{C}_{OUT}(t)a_0(t) \quad (13)$$

where $\tilde{C}_{OUT}$ (t) represents the modeled gas-out, with $d_t\tilde{C}_{OUT}(t)$ representing the first derivative of $\tilde{C}_{OUT}(t)$ with respect to time, $C_{IN}(t)$ represents gas-in (e.g., as modeled in Eq. (3)), and $\tilde{C}_F$ (t) represents the modeled concentration of the formation gas. $\Delta t_{CT}$ represents the delay associated with the circulation time of the drilling fluid through the well and $\Delta t_{LT}$ represents the lag time it takes for the drilling fluid to reach the surface after passing through the drill bit jets at the bottom of the wellbore. The model parameter $a_0(t)$ represents the degassing rate at the gas-out measurement. The model parameters and $a_{10}(t)=w_{10}(t)\cdot a_0(t)\in[0, a_0(t)]$ and $a_{F0}(t)=w_{F0}(t)\cdot a_0(t)\in[0, a_0(t)]$ are model parameters representing the fractions $w_{10}$ and $w_{F0}$ of gas-in and formation gas contributing to gas-out. The gas fractions $w_{10}$ and $w_{F0}$ represent ratio mixing proportions (or fractions) of gas-in and the formation gas such that $w_{F0}(t)$, $w_{10}(t)\geq 0$ and $w_{F0}(t)+w_{10}(t)=1$ and are related to the rate of penetration, for example, as follows:

$$w_{10}(r) = \frac{Q_1(t-\Delta t_{LT}, x_{BIT}(t-\Delta t_{LT}))}{V_{ROP}(t-\Delta t_{LT}) + Q_1(t-\Delta t_{LT}, x_{BIT}(t-\Delta t_{LT}))}$$

$$w_{F0}(t) = \frac{V_{ROP}(t-\Delta t_{LT})}{V_{ROP}(t-\Delta t_{LT}) + Q_1(t-\Delta t_{LT}, x_{BIT}(t-\Delta t_{LT}))}$$

The modeled concentration of the formation gas $\tilde{C}_F(t)$ may be estimated either by treating the two delay first order ODEs (Eqs. (3) and (13)) as a system of equations or by combining them to obtain a delay second order ordinary differential equation. In either case there is no need for one of the gas-in or gas-out measurements.

A delay second order ordinary differential equation may be obtained by rearranging Eq. (13) (the delay first order ODE predicting gas-out) and substituting it into Eq. (3) (the delay first order ODE predicting gas-in). For example, Eq. (13), may be rearranged as follows:

$$\tilde{C}_{IN}(t-\Delta t_{CT}) = C_F(t-\Delta t_{LT})\frac{a_{F0}}{a_{10}} - C_{OUT}(t)\frac{a_0}{a_{10}} - d_tC_{OUT}(t)\frac{1}{a_{10}}$$

Substituting into Eq. (3) and simplifying yields the following delay second order ODE:

$$d_tC_{OUT}(t)b_1(t) = C_{OUT}(t-[\Delta t_{STT}+\Delta t_{CT}])b_3(t) - C_{OUT}(t)b_2(t) - d_t^2C_{OUT}(t) + b_4(t) \quad (14)$$

where $C_{OUT}(t)$ represents the measured gas-out as described above with respect to Eq. (3), $d_tC_{OUT}(t)$ and $d_t^2C_{OUT}(t)$ represent first and second derivatives thereof with respect to time t, and $\Delta t_{STT}$ and $\Delta t_{CT}$ are as defined above. With continued reference to Eq. (14), $b_1(t)$, $b_2(t)$, $b_3(t)$, and $b_4(t)$ may be further defined below with respect to quantities defined above with respect to Eqs. (3) and (13):

$$b_1(t) = a_0(t) + a_1(t)$$

$$b_2(t) = a_0(t)\cdot a_1(t)$$

$$b_3(t) = a_{01}(t)\cdot a_{10}(t) = q_{01}a_1(t)\cdot w_{10}a_0(t)$$

$$b_4(t) = [d_tC_F(t) + C_F(t)a_1(t)](1-w_{10})a_0(t)$$

where $a_0(t)$, $a_1(t)$, $w_{10}$, and $q_{01}$ are as defined above with respect to Eqs. (3) and (13), $C_F(t)$ represents the modeled concentration of the formation gas, and $d_tC_F(t)$ represents the first derivative of the modeled concentration of the formation gas with respect to time.

In certain example embodiments, it may be assumed that that the formation gas concentration doesn't change with time (e.g., within a particular formation layer or reservoir), i.e., that $d_tc_F(t)=0$ and $c_F(t)=c_F$, then $b_4$ may be simplified as follows:

$$b_4(t) = C_F(1-w_{10})b_2(t) = C_Fw_{F0}b_2(t) \quad (15)$$

where $w_{10}$ represents the gas-in fraction of the gas concentration and $w_{F0}$ represents the fraction of the gas concentration introduced by the formation as described above with respect to Eq. (13).

The model coefficients $b_1(t)$, $b_2(t)$, $b_3(t)$, and $b_4(t)$ may be calibrated using the gas-out measurements $c_0(t)$, for example, via by minimizing a second order cost function/norm such as the following:

$$C_{OUT}(t-[\Delta t_{STT}+\Delta t_{CT}])b_3(t) - C_{OUT}(t)b_2(t) - d_t^2C_{OUT}(t) + b_4(t) - d_tC_{OUT}(t)b_1(t) \quad (16)$$

Model parameters $a_0(t)$ and $a_1(t)$ may be estimated from calibrated $b_1(t)$ and $b_2(t)$ values, for example, as follows:

$$a_0(i) = \frac{b_1(t) + \sqrt{b_1(t)^2 - 4b_2(t)}}{2}$$

$$a_1(t) = \frac{b_1(t) - \sqrt{b_1(t)^2 - 4b_2(t)}}{2}$$

Upon calibration of Eqs. (14) and/or (16), the concentration of the formation gas $C_F$ may be estimated, for example, using Eq. (15) provided that $w_1$ and/or $w_{F0}$ are known (or may be estimated). These gas fractions may be estimated, for example, as given above with respect to Eq. (13).

In a related example embodiment, model coefficients $b_1(t)$, $b_2(t)$, and $b_3(t)$ may be calibrated during a time period in which no formation gas is generated (or expected), i.e., when $c_F=0$, $w_{01}=1$ and $b_4\approx 0$). This may be accomplished, for example, when drilling a formation that is not gas bearing or when circulating drilling fluid through the wellbore with the drill bit off bottom. In this other embodiment, $b_1(t)$, $b_2(t)$, and $b_3(t)$ may be calibrated by minimizing the second order cost function/norm such as the following.

$$C_{OUT}(t-[\Delta t_{STT}+\Delta t_{CT}])b_3(t)- C_{OUT}(t)b_2(t)-d_t^2C_{OUT}(t)-d_tC_{OUT}(t)b_1 \quad (17)$$

Figure 5A:
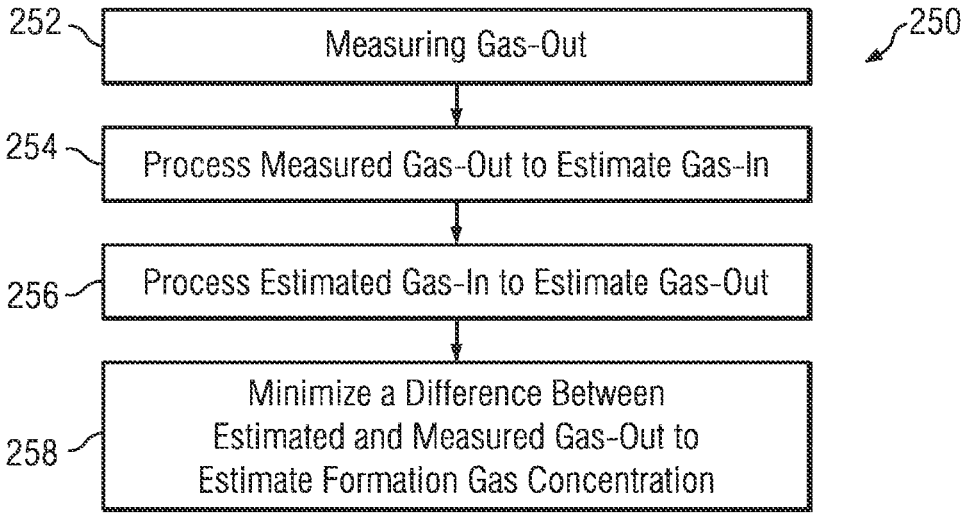
FIGS. 5A and 5B (collectively FIG. 5) depict flow charts of other example methods for predicting formation gas concentrations while drilling.

Turning now to FIGS. 5A and SB (collectively FIG. 5) flow charts illustrating example methods 250 and 260 for predicting formation gas concentrations while drilling are shown. In FIG. 5A, method 250 includes making a plurality of sequential gas-out measurements at 252 while drilling, for example, at some time interval while drilling. The gas-out measurements are then processed at 254, for example, using surface model 210 to estimate corresponding gas-in values. The gas-in values are then processed at 256, for example, using subsurface model 220 to estimate corresponding gas-out values. The formation gas concentration is estimated at 258 by iteratively comparing (e.g., by minimizing a difference between) the gas-out estimates obtained at 256 and the gas-out measurements made at 252. It will be appreciated that the estimated gas-out values obtained in 256 are time delayed with respect to the gas-out measurements made at 252 (e.g., by a circulation time of the drilling fluid). Therefore, the comparison in 258 may include time shifting the gas-out measurements or the predicted gas-out values by an estimated drilling fluid circulation time to obtain synchronized gas-out measurements and predicted gas-out values and then comparing the synchronized gas-out measurements and predicted gas-out values. A formation gas concentration estimate may be selected and output, for example, when the comparison yields a difference that is less than a predetermined threshold (or that minimizes the difference).

Figure 5B:
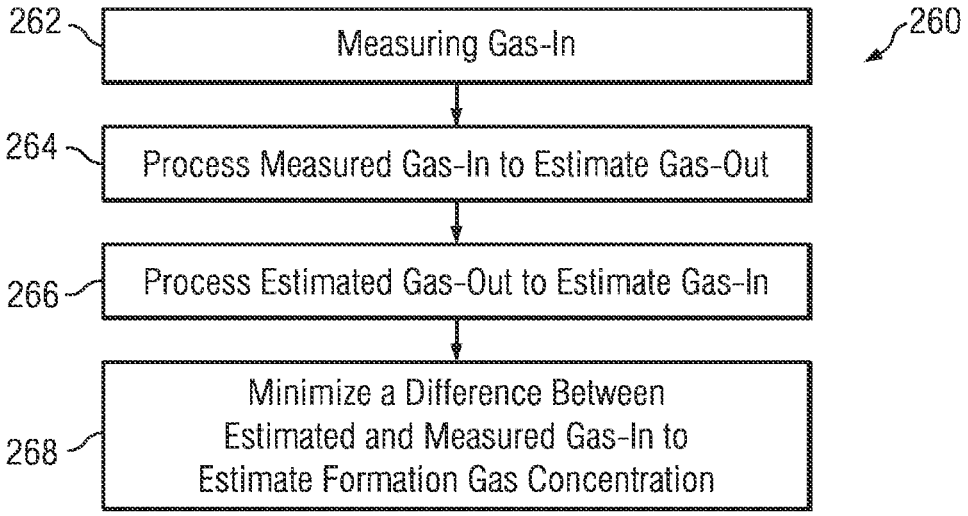

In FIG. 5B, method 260 includes making a plurality of sequential gas-in measurements at 262 while drilling, for example, at some time interval while drilling. The gas-in measurements are then processed at 264, for example, using subsurface model 220 to estimate corresponding gas-out values. The estimated gas-out values are then processed at 266, for example, using surface model 210 to estimate corresponding gas-in values. The formation gas concentration is estimated at 268 by iteratively comparing (e.g., computing a difference between) the gas-in estimates obtained at 266 and the gas-in measurements made at 262. It will be appreciated that the estimated gas-in values obtained in 266 are time delayed with respect to the gas-in measurements made at 262 (e.g., by a circulation time of the drilling fluid). Therefore, the comparison in 268 may include time shifting the gas-in measurements or the predicted gas-in values by an estimated drilling fluid circulation time to obtain synchronized gas-in measurements and predicted gas-in values and then comparing the synchronized gas-in measurements and predicted gas-in values. A formation gas concentration estimate may be selected and output, for example, when the comparison yields a difference that is less than a predetermined threshold (or that minimizes the difference).

It will be appreciated that models 100 and 200 shown on FIGS. 2 and 4 and methods 150, 250, and 260 (flow charts of which are shown on FIGS. 3 and 5) may be used to estimate formation gas concentrations of substantially any gases found in a subterranean formation, for example, including alkane gases such as methane, ethane, propane, butane, pentane, and the like and alkene gases such as ethylene, propylene, butylene, and the like. Moreover, the disclosed embodiments may be used to evaluate multiple formation gases.

It will be understood that the present disclosure includes numerous embodiments. These embodiments include, but are not limited to, the following embodiments.

In a first embodiment, a method for estimating a formation gas concentration while drilling includes making first gas concentration measurements in drilling fluid as the drilling fluid exits a wellbore (gas-out) or second gas concentration measurements in drilling fluid before the drilling fluid is pumped into the wellbore (gas-in) while drilling the wellbore; and estimating the formation gas concentration by evaluating the first gas-out measurements or the second gas-in measurements with a model.

A second embodiment may include the first embodiment, wherein the model includes a surface model coupled with a subsurface model such that output from the surface model is received as input to the subsurface model or output from the subsurface model is received as input to the surface model.

A third embodiment may include the second embodiment, wherein the surface model comprises a first order delay differential equation.

A fourth embodiment may include any one of the first through third embodiments, wherein the model comprises a surface model configured to estimate gas transport and degassing of the drilling fluid in surface equipment and to output gas-in gas concentrations; and a subsurface model configured to estimate formation gas mixing with the drilling fluid as the formation gas is released from a formation during drilling and output gas-out gas concentrations.

A fifth embodiment may include the fourth embodiment, wherein the subsurface model estimates a quantity of the formation gas that mixes with the drilling fluid as being proportional to the formation gas concentration.

A sixth embodiment may include any one of the fourth through fifth embodiments, wherein the subsurface model estimates a quantity of the formation gas that mixes with the drilling fluid as being proportional to the formation gas concentration and a rate of penetration while drilling.

A seventh embodiment may include the sixth embodiment, further comprising measuring the rate of penetration while drilling; and wherein the estimating further comprises evaluating the first gas-out measurements or the second gas-in measurements and the measured rate of penetration with the model to estimate the formation gas concentration.

An eighth embodiment may include any one of the fourth through seventh embodiments, wherein the subsurface model further accounts for mixing of an annular flow of the drilling fluid and a booster line flow of the drilling fluid at a blowout preventer.

A ninth embodiment may include any one of the fourth through eighth embodiments, wherein the model comprises (i) a second order differential equation or (ii) a system of at least first and second first order differential equations.

A tenth embodiment may include any one of the first through ninth embodiments, wherein the estimating comprises using a surface model to predict gas-in concentrations from the gas-out measurements; using a subsurface model to predict gas-out concentrations from the predicted gas-in concentrations, wherein the predicted gas-out concentrations are related to the estimated formation gas concentration in the subsurface model; iteratively comparing the predicted gas-out concentrations with the gas-out measurements while adjusting the estimated formation gas concentration in the subsurface model; and outputting the estimated formation gas concentration that minimizes a difference between the predicted gas-out concentrations and the gas-out measurements.

An eleventh embodiment may include any one of the first through tenth embodiments, wherein the estimating comprises using a subsurface model to predict gas-out concentrations from the gas-in measurements, wherein the predicted gas-out concentrations are related to the estimated formation gas concentration in the subsurface model; using a surface model to predict gas-in concentrations from the predicted gas-out concentrations; iteratively comparing the predicted gas-in concentrations with the gas-in measurements while adjusting the estimated formation gas concentration in the subsurface model; and outputting the estimated formation gas concentration that minimizes a difference between the predicted gas-out concentrations and the gas-out measurements.

A twelfth embodiment may include any one of the first through eleventh embodiments, wherein the gas-out measurements and the second gas-in measurements comprise measurements of an alkane gas concentration.

In a thirteenth embodiment, a surface system configured for use on a drilling rig comprises a gas measurement module configured to make first gas concentration measurements in drilling fluid as the drilling fluid exits a wellbore (gas-out) or second gas concentration measurements in drilling fluid before the drilling fluid is pumped into the wellbore (gas-in) while drilling a wellbore; and a processor configured to receive the first gas-out measurements or the second gas-in measurements; and estimate a formation gas concentration by evaluating the first gas-out measurements or the second gas-in measurements with a model.

A fourteenth embodiment may include the thirteenth embodiment, wherein the model comprises a surface model configured to estimate gas transport and degassing of the drilling fluid in surface equipment and to output gas-in concentrations; and a subsurface model configured to estimate formation gas mixing with the drilling fluid as the formation gas is released from the formation during drilling and output gas-out concentrations.

A fifteenth embodiment may include the fourteenth embodiment, wherein the subsurface model estimates a quantity of formation gas that mixes with the drilling fluid as being proportional to the formation gas concentration and a rate of penetration while drilling.

In a sixteenth embodiment, a method for estimating a formation gas concentration while drilling comprises making gas concentration measurements in drilling fluid as the drilling fluid exits a wellbore (gas-out) while drilling; using a surface model to predict gas concentrations in the drilling fluid before the drilling fluid enters the wellbore (gas-in) from the gas-out measurements; using a subsurface model to predict gas-out concentrations from the predicted gas-in concentrations, wherein the predicted gas-out concentrations are related to the estimated formation gas concentration in the subsurface model; iteratively comparing the predicted gas-out concentrations with the gas-out measurements while adjusting the estimated formation gas concentration in the subsurface model; and outputting the estimated formation gas concentration that minimizes a difference between the predicted gas-out concentrations and the gas-out measurements.

A seventeenth embodiment may include the sixteenth embodiment, wherein the iteratively comparing comprises time shifting the gas-out measurements or the predicted gas-out concentrations by an estimated drilling fluid circulation time to obtain synchronized gas-out measurements and predicted gas-out concentrations; and iteratively comparing the synchronized gas-out measurements and predicted gas-out concentrations while adjusting the estimated formation gas concentration in the subsurface model.

An eighteenth embodiment may include any one of the sixteenth through seventeenth embodiments, further comprising measuring a rate of penetration while drilling; and wherein the using the subsurface model to predict gas-out concentrations further comprises evaluating the predicted gas-in concentrations and the rate of penetration with the subsurface model to predict the corresponding gas-out concentrations, the predicted gas-out concentrations being related to the estimated formation gas concentration and the rate of penetration in the subsurface model.

A nineteenth embodiment may include any one of the sixteenth through eighteenth embodiments, wherein the surface model is configured to estimate gas transport and degassing of the drilling fluid in surface equipment and to output gas-in concentrations; and the subsurface model is configured to estimate formation gas mixing with the drilling fluid as the formation gas is released from the formation during drilling and output gas-out concentrations.

A twentieth embodiment may include the nineteenth embodiment, wherein the subsurface model estimates a quantity of formation gas that mixes with the drilling fluid as being proportional to the formation gas concentration and a rate of penetration while drilling.

Although prediction of gas concentrations in a subterranean formation has been described in detail, it should be understood that various changes, substitutions and alternations can be made herein without departing from the spirit and scope of the disclosure as defined by the appended claims.

What is claimed is:

1. A method, comprising:

making first gas concentration measurements in drilling fluid before the drilling fluid is pumped into a wellbore (gas-in measurements) while drilling the wellbore;

estimating a formation gas concentration by evaluating the gas-in measurements with a model, wherein the estimating comprises:

using a surface model to predict gas-out concentrations from the gas-in measurements by estimating gas transport and degassing of the drilling fluid in surface equipment attributed to a decrease of gasses in the drilling fluid due to pressure differences between the drilling fluid and air at a surface location adjacent the wellbore as well as mechanical interaction of the drilling fluid with the surface equipment and other components of a circulation system;

using a subsurface model to predict gas-in concentrations from the predicted gas-out concentrations by estimating formation gas mixing with the drilling fluid as the formation gas is released from a formation during drilling at location in the wellbore at or near a drill bit utilized in the drilling, wherein the predicted gas-in concentrations are related to the estimated formation gas concentration in the subsurface model; and iteratively comparing the predicted gas-in concentrations with the gas-in measurements while adjusting an estimation of the formation gas concentration in the subsurface model to generate a resultant estimated formation gas concentration while drilling; and outputting the resultant estimated formation gas concentration to a mud logger as indicative of fluid degassing rates and which types of gases are present in a formation undergoing the drilling, wherein the resultant estimated formation gas concentration minimizes a difference between the predicted gas-in concentrations and the gas-in measurements.

2. The method of claim 1, wherein the surface model is coupled with the subsurface model such that output from the surface model is received as input to the subsurface model or output from the subsurface model is received as input to the surface model.

3. The method of claim 2, wherein the surface model comprises a first order delay differential equation.

4. The method of claim 1, wherein the subsurface model estimates a quantity of the formation gas that mixes with the drilling fluid as being proportional to the formation gas concentration.

5. The method of claim 1, wherein the subsurface model estimates a quantity of the formation gas that mixes with the drilling fluid as being proportional to the formation gas concentration and a rate of penetration while drilling.

6. The method of claim 5, further comprising:

measuring the rate of penetration while drilling; and wherein the estimating further comprises evaluating the gas-in measurements and the measured rate of penetration with the model to estimate the formation gas concentration.

7. The method of claim 1, wherein the subsurface model further accounts for mixing of an annular flow of the drilling fluid and a booster line flow of the drilling fluid at a blowout preventer.

8. The method of claim 1, wherein the model comprises (i) a second order differential equation or (ii) a system of at least first and second first order differential equations.

9. The method of claim 1, wherein the gas-in measurements comprise measurements of an alkane gas concentration.

10. A method, comprising:

making gas concentration measurements in drilling fluid as the drilling fluid exits a wellbore (gas-out measurements) while drilling;

using a surface model to predict gas concentrations in the drilling fluid before the drilling fluid enters the wellbore (predicted gas-in concentrations) from the gas-out measurements by estimating gas transport and degassing of the drilling fluid in surface equipment attributed to a decrease of gasses in the drilling fluid due to pressure differences between the drilling fluid and air at a surface location adjacent the wellbore as well as mechanical interaction of the drilling fluid with the surface equipment and other components of a circulation system;

using a subsurface model to predict gas-out concentrations from the predicted gas-in concentrations by estimating formation gas mixing with the drilling fluid as the formation gas is released from a formation during drilling at location in the wellbore at or near a drill bit utilized in the drilling, wherein the predicted gas-out concentrations are related to an estimated formation gas concentration in the subsurface model;

iteratively comparing the predicted gas-out concentrations with the gas-out measurements while adjusting an estimation of the formation gas concentration in the subsurface model to generate the resultant estimated formation gas concentration while drilling; and outputting the resultant estimated formation gas concentration to a mud logger as indicative of fluid degassing rates and which types of gases are present in a formation undergoing the drilling, wherein the resultant estimated formation gas concentration minimizes a difference between the predicted gas-out concentrations and the gas-out measurements.

11. The method of claim 10, wherein the iteratively comparing comprises:

time shifting the gas-out measurements or the predicted gas-out concentrations by an estimated drilling fluid circulation time to obtain synchronized gas-out measurements and predicted gas-out concentrations; and iteratively comparing the synchronized gas-out measurements and predicted gas-out concentrations while adjusting the estimated formation gas concentration in the subsurface model.

12. The method of claim 10, further comprising:

measuring a rate of penetration while drilling; and wherein the using the subsurface model to predict gas-out concentrations further comprises evaluating the predicted gas-in concentrations and the rate of penetration with the subsurface model to predict the corresponding gas-out concentrations, the predicted gas-out concentrations being related to the estimated formation gas concentration and the rate of penetration in the subsurface model.

13. The method of claim 10, wherein the subsurface model estimates a quantity of formation gas that mixes with the drilling fluid as being proportional to the formation gas concentration and a rate of penetration while drilling.

14. A method, comprising:

making first gas concentration measurements in drilling fluid as the drilling fluid exits a wellbore (gas-out measurements) or second gas concentration measurements in drilling fluid before the drilling fluid is pumped into the wellbore (gas-in measurements) while drilling the wellbore;

selectively estimating a formation gas concentration by evaluating the gas-out measurements or the gas-in measurements with a model, wherein, in response to the gas-in measurements being made, the selectively estimating comprises:

using a subsurface model to predict gas-out concentrations from the gas-in measurements by estimating formation gas mixing with the drilling fluid as the formation gas is released from a formation during drilling at location in the wellbore at or near a drill bit utilized in the drilling, wherein the predicted gas-out concentrations are related to the estimated formation gas concentration in the subsurface model;

using a surface model to predict gas-in concentrations from the predicted gas-out concentrations by estimating gas transport and degassing of the drilling fluid in surface equipment attributed to a decrease of gasses in the drilling fluid due to pressure differences between the drilling fluid and air at a surface location adjacent the wellbore as well as mechanical interaction of the drilling fluid with the surface equipment and other components of a circulation system; and iteratively comparing the predicted gas-in concentrations with the gas-in measurements while adjusting an estimation of the formation gas concentration in the subsurface model to generate a first resultant estimated formation gas concentration while drilling;

wherein, in response to the gas-out measurements being made, the selectively estimating comprises:

using a subsurface model to predict gas-in concentrations from the gas-out measurements by estimating formation gas mixing with the drilling fluid as the formation gas is released from a formation during drilling at location in the wellbore at or near a drill bit utilized in the drilling, wherein the predicted gas-in concentrations are related to the estimated formation gas concentration in the subsurface model;

using a surface model to predict gas-out concentrations from the predicted gas-in concentrations by estimating gas transport and degassing of the drilling fluid in surface equipment attributed to a decrease of gasses in the drilling fluid due to pressure differences between the drilling fluid and air at a surface location adjacent the wellbore as well as mechanical interaction of the drilling fluid with the surface equipment and other components of a circulation system; and iteratively comparing the predicted gas-out concentrations with the gas-out measurements while adjusting an estimation of the formation gas concentration in the subsurface model to generate a second resultant estimated formation gas concentration while drilling; and outputting the first resultant estimated formation gas concentration in response to the gas-in measurements being made to a mud logger as indicative of fluid degassing rates and which types of gases are present in a formation undergoing the drilling, wherein the first resultant estimated formation gas concentration minimizes a difference between the predicted gas-out concentrations and the gas-out measurements or outputting the second resultant estimated formation gas concentration in response to the gas-out measurements being made to a mud logger as indicative of fluid degassing rates and which types of gases are present in the formation undergoing the drilling, wherein the second resultant estimated formation gas concentration minimizes a difference between the predicted gas-out concentrations and the gas-out measurements.

* * * * *